United States Patent [19]

Grosjean

[11] 4,251,914

[45] Feb. 24, 1981

[54] SHAVING ASSEMBLY

[76] Inventor: Warren J. Grosjean, 32 Juniper Rd., Wayne, N.J. 07470

[21] Appl. No.: 83,564

[22] Filed: Oct. 11, 1979

[51] Int. Cl.[3] ..... B26B 21/00

[52] U.S. Cl. ..... 30/32; 30/84

[58] Field of Search ..... 30/32, 77, 84, 31

[56] References Cited

U.S. PATENT DOCUMENTS

| | | | |
|---|---|---|---|
| 1,477,689 | 12/1923 | Burns | 30/31 |
| 1,897,982 | 2/1933 | Jones | 30/77 X |
| 2,018,304 | 10/1935 | Hayhurst | 30/32 X |
| 2,367,517 | 1/1945 | Muros | 30/84 X |
| 2,666,982 | 1/1954 | Schroder | 30/77 X |
| 2,795,847 | 6/1957 | Arnade | 30/84 X |
| 2,866,264 | 12/1958 | Hightower | 30/31 |
| 3,004,337 | 10/1961 | Schweizer | 30/77 X |
| 3,488,764 | 1/1970 | Welsh | 30/32 |
| 3,675,323 | 7/1972 | Braginetz | 30/84 X |

*Primary Examiner*—Jimmy C. Peters
*Attorney, Agent, or Firm*—Weingram & Klauber

[57] ABSTRACT

A shaving assembly is disclosed for use in surgical shaving or the like, the assembly being adapted to effect removal of hair close to the skin without damaging the epidermis. The assembly comprises a blade seat, and a blade cap secured to the seat, with the outwardly facing surface of the cap being substantially planar and defining a locating and reference plane for contacting the surface of skin to be shaved, whereby to locate and orient the assembly with respect to the skin. Handle means extend from the assembly for grasping and drawing same across the skin in a given direction during shaving. Razor blade means are secured between the seat and cap. The cutting edge portion of the blade means protrude in the given direction beyond the edge of the cap, and the center plane of such portion makes an angle of from about −5° to 14° with respect to the locating and reference plane, where the negative and positive signs of the angle respectively indicate convergence or divergence (in said given direction) between the cutting edge portion plane and the locating and reference plane. The terminal cutting edge of such portion is, further, spaced from the locating and reference plane in the direction of the seat. In consequence of the foregoing arrangement, hairs are cut in scythe-like fashion during the shaving process, by the cutting edge intersecting the hairs above the skin, and substantially without the cutting edge contacting the skin.

14 Claims, 9 Drawing Figures

SHAVING ASSEMBLY

BACKGROUND OF INVENTION

This invention relates generally to devices for shaving portions of the human body, and more specifically, relates to a shaving assembly, which while generally useful in body shaving applications, is especially applicable to shaving which is effected as an incident of surgical procedures.

As one aspect of surgical treatment of portions of the human body, as for example, as an incident of treatment of trauma or disease, the physician or other treating personnel may be required to eliminate surface hair which could interfere with the surgical procedure or with healing of the impaired bodily portion. Removal of such surface hair has customarily been effected by use of one of two procedures, i.e. by razor preparation, or by use of a depilatory. Since certain aesthetic and physiologically objectionable characteristics are inherent in use of depilatories, the preferred and most widely used preparatory technique, indeed involves use of shaving via a razor assembly.

In recent years it has come to be increasingly recognized, however, that razor preparation can contribute to post-operative complications by virtue of injury to the epidermis which is often incident to such technique. Reference may be had in this connection, for example, to the article by Richard Seropian, M.D., and Benedict M. Reynolds, M.D., entitled "Wound Infections After Pre-operative Depilatory versus Razor Preparation", appearing in the *American Journal of Surgery,* Volume 121 (March, 1971). The sheer economic impact of such shaving-induced infection, e.g. in resulting increased length of hospital stay, is also very significant, and is discussed in an article appearing in the "Medical News" section of the *Journal of the American Medical Association,* pgs 9 f.f., Jan. 2, 1978, Vol. 239, No. 1.

Analysis of prior art shaving techniques will establish that the shaving of hair has conventionally involved the concept of trapping the hair between a relatively sharp blade edge and the skin adjacent to the hair follicle. Before the advent of the safety razor, in addition to the trapping action, the blade edge was moved so as to provide a slicing type of action. Even with extreme care, the epidermal layer of the skin was broached extensively. The conventional safety razor design was such that a slicing type of action was not practical, and the cutting action resembled more the action of a hoe cutting weeds in a garden. Just as the hoe damages the earth adjacent to the weeds in the garden, so does the safety razor blade damage the epidermis next to the follicle of the hair.

The above points are illustrated in FIG. 7 herein, which is a schematic enlarged view of the operative portions of a typical prior art safety razor, illustrating the manner in which these portions function during the shaving operation. This view, which is thus in section and simplified, shows a razor blade 2 sandwiched between a blade seat 4 and a blade cap 6. The guide bar 8 typically present in the shaving assembly 3 is also shown, and it may be assumed that during shaving the assembly 3 is drawn in the direction of arrow 5.

Particularly to be noted in FIG. 7 is that the protruding portion 9 of the blade 2, actually is designed so that the terminal cutting edge 11 extends a distance D' beyond a reference plane 13 which is defined by the outer surface 15 of cap 6 and the cooperating surface 17 of guide bar 8 which resides across from surface 15 in the direction of cutting edge 11. Plane 13 approximately coincides with the theoretical surface of skin 19, and it will be seen that the cutting edge 11 thus extends by the said distance D' beyond the theoretical skin surface, but extends by a distance D, which is greater than D', beneath the true skin line—by virtue of the deformation of the skin (such as at 19*a*) which occurs during shaving.

The effect of this protrusion beyond the theoretical and actual skin lines is that the blade edge 11, at the least rubs along the skin, and more generally shaves into the epidermis. In the case where the epidermis is thin, as in most parts of the body other than the pads of the hands and feet and the face of shaving males, the epidermis is severely broached, with consequent rawness, bleeding and opportunity for infection.

In general, therefore, the degree and extent of damage to the epidermis is a function of the protrusion depth D' of the blade cutting edge beyond the guide plane established by the razor guide bar 8 and the razor cap 6, the angle at which the blade approaches the skin (the "angle of attack"), and of other factors including the sharpness of the blade, the softness of the hair, the toughness of the epidermis, and the degree and direction of turn on the edge of the blade.

While the above comments have been directed particularly at the undesirable aspects of prior art razors as same are utilized in surgical shaving, it will of course, also be evident that the remarks are equally applicable to any shaving operation, i.e. including those conducted for cosmetic or other reasons.

Pursuant to the foregoing, it may be regarded as an object of the present invention, to provide a shaving assembly which enables removal of excess body hair as an incident to surgical or other needs, without damaging the epidermis, thereby minimizing the risk of infection incident to such shaving.

It is a further object of the present invention, to provide a shaving assembly as aforesaid, which enables a substantial reduction in the cost of surgical preparation supplies, by reducing or completely obviating the need for lather, sponge, and disinfectant use.

It is a still further object of the invention, to provide a shaving assembly as aforesaid, which enables a substantial reduction in the time required to perform preparatory shaving operations, by obviating any requirement for softening of the hair by lathering or otherwise, by enabling ready visability of the hair being shaven, and by eliminating a requirement for rinsing or otherwise removing the shaved hair from the razor's cutting edge.

SUMMARY OF INVENTION

Now in accordance with the present invention, the foregoing objects, and others as will become apparent in the course of the ensuing specification, are achieved in a shaving assembly that is especially applicable for use in surgical shaving or the like, but which may be used in numerous other environments wherein shaving is to be effected, the said assembly being adapted to effect shaving without damaging the epidermis.

The assembly comprises a blade seat and a blade cap secured to the seat, with the outwardly facing surface of the cap being substantially planar and defining a locating and reference plane for contacting the surface of skin to be shaved, whereby to locate and orient the assembly with respect to the skin. Handle means extend from the assembly, to enable grasping and drawing of the assembly across the skin in a given direction during shaving.

Razor blade means are secured between the seat and cap. The cutting edge portion of the blade means protrude in the given direction beyond the edge of the cap. The protrusion beyond the cap is preferably in the range of about 0.003 to 0.020 inches, and optimally around 0.010 inches. The center plane of such protruding portion makes an angle of from about −5° to +14° with respect to the locating and reference plane, preferably makes an angle of from about 0° to +9°, and yet more optimally, makes an angle in the range of 0° to +6°. This angle may, from time to time in this specification, be referred to as the "angle of attack" of the cutting edge portion of the blade means, and shall mean the acute angle (or zero angle) which is defined between the said center plane of the cutting edge portion and the said locating and reference plane. Such angle shall be regarded as positive (+) where the center plane of the cutting edge portion converges toward the reference plane in the said given direction; conversely, the said angle shall be regarded as negative (−) where the center plane of the cutting edge portion diverges from the reference plane as one proceeds in the said given direction. Thus, a positive angle of attack indicates that the cutting edge portion of the blade means is depressed below a plane parallel to the reference plane and thus points toward the reference plane and toward the skin being shaved. Similarly, a negative angle of attack means that the center plane of the blade means that the cutting edge portion is angularly elevated above a plane parallel to the reference plane, so that the said cutting edge portion points away from the reference plane, and thus is angled away from the skin being shaved.

The terminal cutting edge of the cutting edge portion, is further, spaced from the locating and reference plane in the direction of the blade seat. In consequence of this factor and of the above-discussed angle of attack, hairs are cut in scythe-like fashion during the shaving process, by the cutting edge intersecting same above the skin, and substantially without the cutting edge contacting the skin.

The forward edge of the blade cap is sloped toward the point where same contacts the protruding blade portion. Further, the cutting edge portion of the blade means terminates in a bevel, the included angle of which is approximately 19°. With the angle of attack residing in the preferable range of about 0° to +9°, the further angularity introduced by the bevel, results in the rearward part of the bevel being closer to the skin than is the terminal cutting edge. In consequence, the bevel surface which is closest to the skin, cooperates with the sloped forward edge of the cap, to displace skin away from the terminal cutting edge of the blade in snow-plow fashion, further reducing any possibility of injury to the epidermis.

The cutting edge portion of the blade means, may in one embodiment of the invention, be formed or bent from the remainder of the blade means, in the direction of the blade seat. This functions to partially bring about the desired low angle of attack.

BRIEF DESCRIPTION OF DRAWINGS

The invention is diagramatically illustrated, by way of example, in the drawings appended hereto, in which.

DESCRIPTION OF PREFERRED EMBODIMENTS

Figure 1:
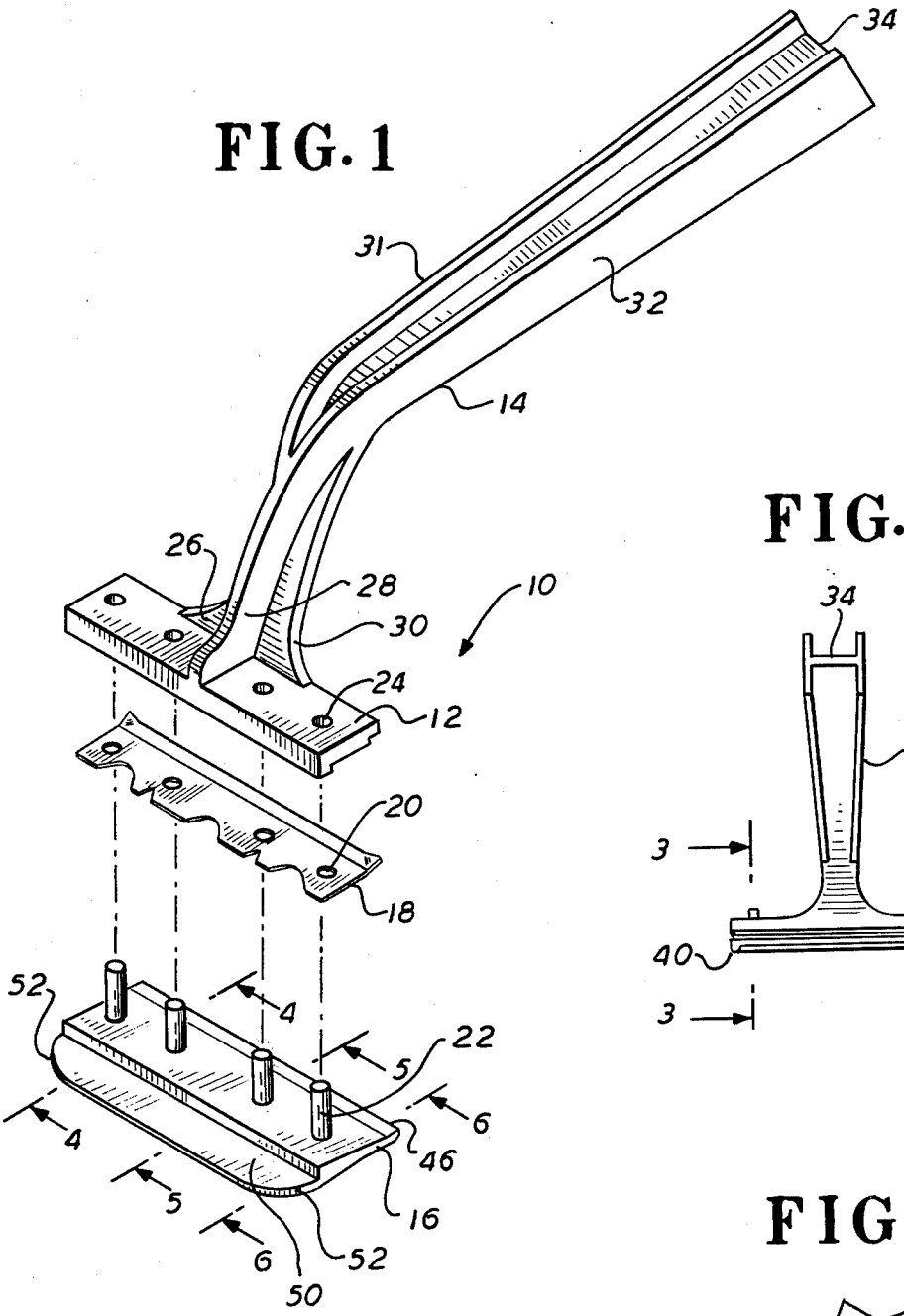
FIG. 1 is a perspective, exploded view of a shaving assembly in accordance with the present invention.

In FIG. 1 herein an exploded perspective view appears of a shaving assembly 10 in accordance with the present invention. FIG. 1 may be considered simultaneously with the remaining Figures herein in order to appreciate the various features of the invention.

Assembly 10 is seen to comprise generally a blade seat 12, from which extends a handle means 14, and a blade cap 16 which is securable to seat 12 with a razor blade means 18 being sandwiched between the seat and cap.

Blade seat 12 is preferably molded as a one-piece unit with handle means 14, and is thus conveniently formed of any readily moldable plastic material, such as, for example, a polystyrene-type plastic or the like. The blade cap 16 may similarly be of one-piece molded construction, of the same plastic material used in forming the blade seat and handle means; or such cap can be formed from other suitable materials.

Razor blade means 18 can be manufactured from a conventionally available razor blade, acceptable types of which are available from numerous sources including from Wilkinson-Sword Co., from the American Safety Razor Corporation, etc. The "off-the shelf" blade thus available is modified for use in the assembly 10, by stamping same to produce the series of circular openings 20, through which stakes 22 which project from cap 16 may pass. Such projections are received into openings 24 formed at seat 12, with an interference fit being provided between stakes 22 and openings 24, so that upon the assembly shown in FIG. 1 being brought into operative relation, the several component pieces are held together by the interference fit in fully effective fashion.

A conventional press can be used for the assembly purposes; and it may be noted in this connection that the three narrow ribs 26, 28, and 30 which are defined where the handle means 14 meets seat 12, facilitates use of such conventional machinery.

Although not illustrated, blade means 18 can also be of the type provided with a foil or thread cover—such as the blades of this type disclosed in U.S. Pat. Nos. 3,505,734 and 3,263,330. A cover of this or similar type may be appropriate where the attack angle is greater than about +9°, and can also be useful in providing an additional factor of safety—which can otherwise be provided by the blade bevel—at angles of attack less than +9°.

Figure 2:
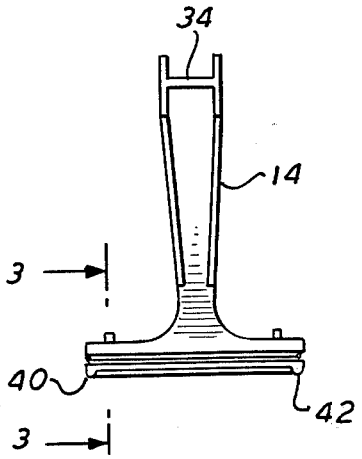
FIG. 2 is a rear elevational view of the said assembly.

To the rear of the said ribs 26, 28, and 30, handle means 14 is defined by two lateral, flattened and diverging walls 31 and 32, which are connected by a cross-member 34. The resultant H-shaped cross-section defining the rearward portions of handle means 14 (FIG. 2) is both comfortable to the grip, of fully adequate strength, and further, is desirable by virtue of the very minimal (and therefore economical) use of material in forming the said shape.

The angle between handle means 14 and the outwardly facing substantially planar surface 38 of blade cap 16, is considerably lower than in conventional razor assemblies. Typically such angle is about 16°, and can be as low as about 12°, with a range of from about 12° to 18° being useful. This low angle serves to encourage proper placement of the cap against the skin, and tends to preclude the possibility of the assembly being tipped to the extent that the blade means cutting edge digs into the skin. Additionally, the low angle encourages and facilitates a natural pulling of the assembly during shaving as opposed to pushing of same.

The entire assembly 10 can comprise a simple, low-cost disposable unit—which is relatively ideal for surgical use. It will be apparent from the ensuing description, however, that the invention is in no way so limited, but can be embodied in other assemblies, e.g. those wherein it is contemplated that the blade be periodically replaced.

During the stamping operation which is normally incident to formation of razor blade means 18, it is in some instances also desirable to slightly bend or form the cutting edge portion 34 (FIG. 8) of such blade means, so that the said portion will have a slight bend in the direction of blade seat 12. This bend, which typically can be of the order of 7° to 8°, can be one factor in reducing the angle of attack of the blade cutting edge to the desired −5° to +14° (preferably below +9°), and will be further discussed hereinbelow.

Figure 4:
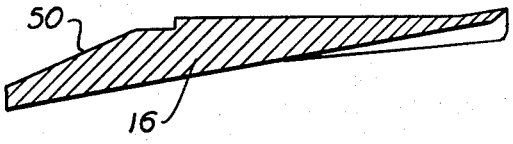
FIG. 4 is a transverse cross-section through the razor cap shown in FIG. 1, the view being taken along the line 4—4 therein.

The blade cap 16 is seen to be provided with a number of features which are highly significant to operation of the invention. Firstly, it will be noted that the outwardly facing surface 38 of the cap 16 is substantially planar, and serves to define a locating and reference plane for contacting the surface of skin to be shaved, whereby to locate and orient the assembly with respect to the skin—as is seen for example, in the diagrammatic showing of FIG. 8. As can be seen from the rear elevational view of FIG. 2 and from FIG. 4, the surface 38 departs slightly from being entirely planar, by virtue of spacer bumps 40 and 42 which are formed at the lateral edges of surface 38. These spacer bumps extend from the forward edge 46 of cap 16 and blend into the planar surface about half-way toward the trailing edge 48 of cap 16. Such spacer bumps serve to assure that the lateral ends of the blade do not touch the skin, and also serve a secondary function of supporting the razor so that the edge of the blade is not damaged during shipping.

It will be noted further that cap 16 includes an extended trailing portion 50 which is rounded at the corners 52 thereof. This extension of surface 38 serves to greatly enlarge the said surface, so as to define a larger locating and reference plane for better orienting the assembly during skin contact. At the same time, the rounded edges 52 enable more ready manipulation of the assembly into areas to be shaved.

Figure 3:
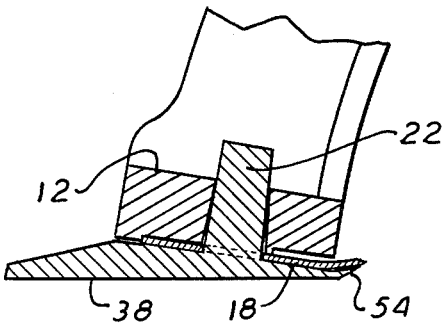
FIG. 3 is a transverse, cross-sectional view through the sandwiched seat, blade means and blade cap, and is taken along the line 3—3 of FIG. 2.
Figure 5:
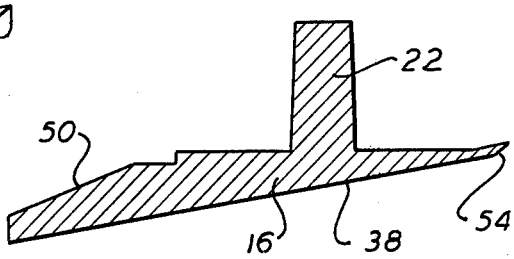
FIG. 5 is a transverse cross-sectional view of the said cap taken along the line 5—5 of FIG. 1.
Figure 6:
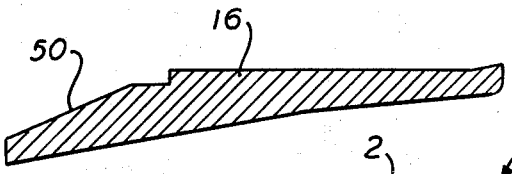
FIG. 6 is a further transverse cross-sectional view of the said cap, taken along the line 6—6 of FIG. 1.
Figure 8:
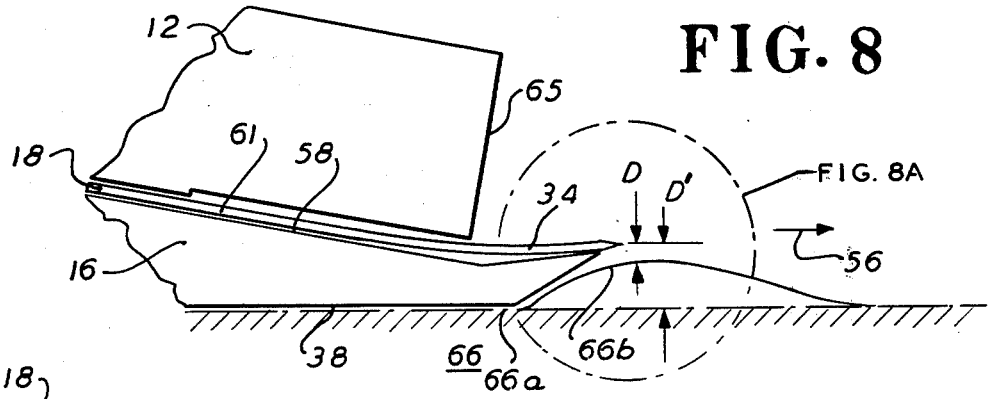
FIG. 8 is a further schematic longitudinal cross-sectional view, similar in nature to FIG. 7, but showing the relationships achieved in the shaving assembly of the present invention.

Referring especially to FIG. 3, to the cross-sectional views of 4 through 6, and to the schematic FIG. 8 view, it is to be noted that the forward edge 46 of the blade cap 16 is formed with a face 54 which is sloped in a forward direction, i.e. face 54 is sloped toward the blade cutting portion 34 in the direction 56 in which the assembly is drawn during the course of shaving. It will be further noted from the cross-sectional views of FIGS. 4 through 6, and especially from FIG. 8, that the face 58 of cap 16 which bears against the blade means 18, includes an extended rearward portion 57 which converges (in the direction 56) toward surface 38, and a portion 59 toward front edge 46 which is angled more toward seat 12. Portion 59 is actually parallel to surface 38—but its angularity is exaggerated in FIG. 8 and especially in FIG. 8A in order to schematically illustrate the function of the bend in face 58. In consequence of this bend—i.e. between portions 57 and 59—when the assembly is brought together as in FIG. 1 to form the sandwiched structure, shown for example in FIG. 3, the blade means 18 will thus tend to be slightly bent at its forward cutting portion 34, again toward the blade seat 12.

The net effect of the bending of the cutting portion 34 of the blade during stamping of same, and of the sandwiching action described in the preceding paragraph, is to cause the forward cutting portion 34 of the blade to be somewhat formed or bent away from the locating and reference plane defined by surface 38. Typically, the bend achieved by stamping can be of the order of 7°–8° with an additional 2°–3° or so achieved by the mentioned sandwiching effect of seat 12 and cap 16 on the blade. Referring to FIG. 8, the central plane of portion 61 of blade means 18 which is rearward of cutting portion 34, typically makes an angle of about +11° with surface 38 (and thus with the locating and reference plane). Thus, the aforementioned combined effects of bending and sandwiching counteract the +11° angle of attack which would otherwise be present, to bring such angle of attack close to 0°.

Figure 8A:
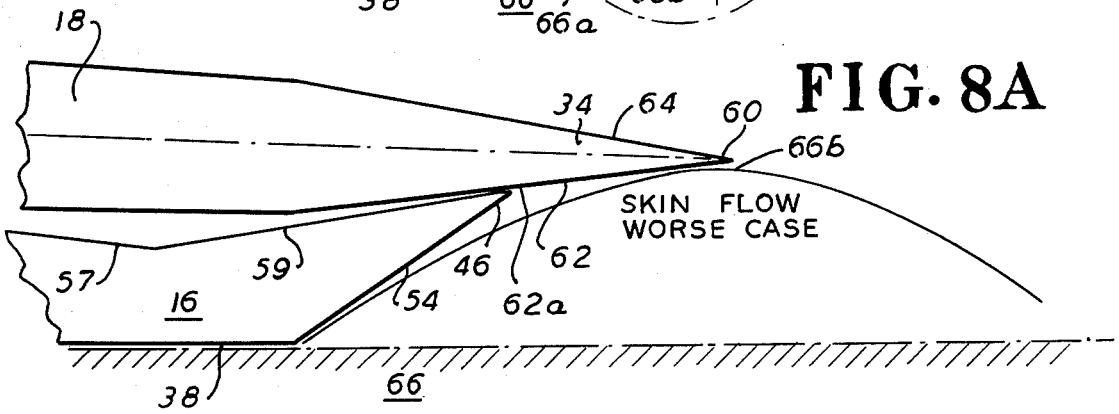
FIG. 8A is an enlarged view of the portion of FIG. 8 within the circle 8A.

In order to fully appreciate the manner in which the present invention functions during shaving, it is further to be borne in mind, that as is apparent from the enlarged view of FIG. 8A, the cutting portion 34 of blade means 16, is provided, as is conventional, with a terminal cutting edge 60 which is defined by a pair of beveled faces 62 and 64. The included angle of the bevel is approximately 19°.

By referring to the schematic views of FIGS. 8 and 8A, the effect of the several aforementioned features in enabling the significant results of the invention will now be appreciated. Referring to those Figures, it will firstly be appreciated that as already mentioned, the forward portion 59 of cap means 16 is bent from rearward portion 57 in the direction of seat 12, so that the surface portion of 59 is approximately parallel to surface 38. The portion of blade means 18 which is forward of cap 16, has been referred to as the "protruding cutting edge portion" 34 of the blade means. The center plane of this portion 34, will in accordance with the invention, make an angle between from about −5° to 14°, preferably from about 0° to +9°, and optimally from about 0° to 6°, with respect to the locating and reference plane at surface 38, where the (+) and (−) signs have the significance heretofore discussed. As already mentioned, this is or can be partially brought about by virtue of the slight bending of portion 34 towards seat 12, either resulting from the stamping operation and/or from the pressure brought about during assembly of seat 12 with cap 16.

Since, as has already also been mentioned, the included angle of the bevel at the terminal cutting edge 60 is approximately 19°, the further angularity introduced by the bevel surface 62 where the angle of attack is in the preferable range of from 0° to +9°, results in the rearward part 62*a* of bevel surface 64 being actually closer to the skin 66 than is the terminal cutting edge 60.

Finally to be noted in FIG. 8 is that the terminal cutting edge 60 is spaced by the distance D' above the plane of surface 38 and the theoretical skin line 66*a*, and is spaced from the "worse case" actual skin line 66*b* by the distance D.

Thus, the several foregoing factors serve to combine with the sloping face 54 defining the forward edge 46 of cap 16, so that as the assembly 10 is drawn in the direction 56 during shaving, the skin flow, which for the "worse case" of loose skin is as at 66*b*, is actually "snow-plowed" away from the terminal cutting edge 60 by virtue both of the sloping face 54, and further by the low angle of attack of the blade cutting edge portion 34.

Figure 7:
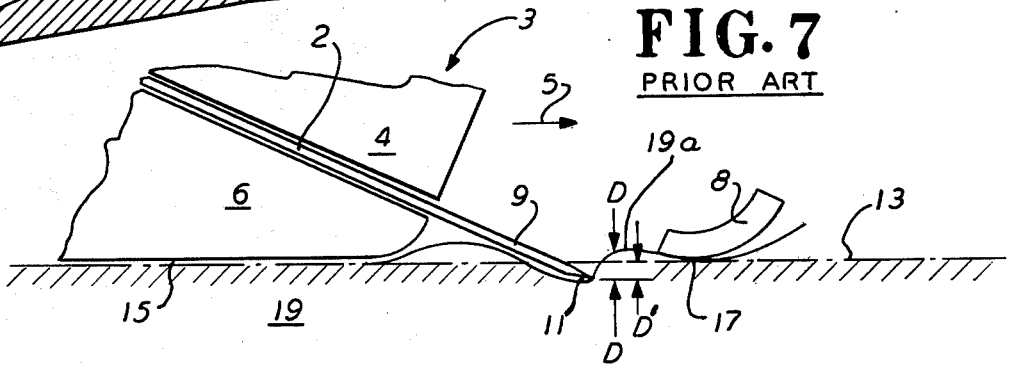
FIG. 7 PRIOR ART
FIG. 7 is a schematic longitudinal cross-sectional view through the shaving head portion of a typical prior art safety razor; this view has already been discussed in the "Background" portion of this specification.

In consequence of the above arrangement, it will be clear that hairs are actually cut in scythe-like fashion by the terminal cutting edge 60 intersecting such hairs above the skin line, and substantially without the cutting edge contacting the skin. In consequence, virtually no damage or injury can occur to the skin; and indeed since the present cutting action is effected without the wedging effect of the prior art (shown in FIG. 7), shaving can actually be effectively conducted without the need for any fluid lubricant, such as water, or shaving cream or the like, which is a further significant advantage in reducing any danger of infection where the said assembly is used for surgical applications.

Additionally, since the type of cutting action provided in the present invention does not involve trapping or wedging of the cut hairs and there is no skin guidance system ahead of the cutting edge, such hairs can fall freely upon being cut, thereby reducing or altogether eliminating any requirement for rinsing or otherwise removing shaved hairs from the razor cutting edge.

While the present invention has been particularly set forth in terms of specific embodiments thereof, it will be understood in view of the instant disclosure, that numerous variations upon the invention are now enabled to those skilled in the art, which variations yet reside within the scope of the present teaching.

For example, while the invention has been particularly discussed with respect to its application to surgical environments, the assembly is ideally adapted to many cosmetic and other uses. Indeed the present invention finds application to virtually any shaving situation wherein closeness of shaving is not as important as is freedom from damage to the epidermis, and where the "pull" associated with the cutting action is not objectionable. In general such shaving environments include all parts of the human body, and can, particularly in the case of males having tough, highly curled whiskers, include as well facial shaving. Thus in the last-cited application, cutting of the whiskers above the skin line is often preferable to the ingrown hairs which can result from the close shave effected by use of conventional shaving assemblies.

Accordingly, the invention is to be broadly construed, and limited only by the scope and spirit of the claims now appended hereto.

I claim:

1. A shaving assembly for use in surgical shaving or the like, said assembly being adapted to effect said shaving without damaging the epidermis, and comprising in combination:

a blade seat;

a blade cap secured to said seat, the outwardly facing surface of said cap being substantially planar and defining a locating and reference plane for contacting the surface of skin to be shaved, whereby to locate and orient said assembly with respect thereto;

handle means extending from said assembly, for grasping and drawing said assembly across said skin in a given direction during shaving; and razor blade means being secured between said seat and cap, the cutting edge portion of said blade means protruding in said given direction beyond the edge of said cap; the center plane of the protruding cutting edge portion making an angle of attack from about −5° to +14° with respect to said locating and reference plane, and the cutting edge terminating said portion being spaced from said plane in the direction of said seat, whereby hairs are cut in scythe-like fashion by intersection of said cutting edge with same above the skin, and substantially without said cutting edge contacting the skin.

2. An assembly in accordance with claim 1, wherein said angle of attack is from about 0° to +9°.

3. An assembly in accordance with claim 1, wherein said angle is from about 0° to +6°.

4. An assembly in accordance with claim 1, wherein the front edge of said cap is sloped in said given direction toward said cutting edge portion of the sandwiched blade means, the sloped face functioning during shaving to snow-plow the skin away from the terminal cutting edge.

5. An assembly in accordance with claim 1, wherein said blade means cutting edge portion protrudes beyond the said cap edge from between 0.003 to 0.020 inches.

6. An assembly in accordance with claim 1, wherein said cutting edge portion of said blade means is beveled at the tip thereof to define said cutting edge, whereby the surface of said bevel toward said reference and locating plane further displaces said skin away from said cutting edge during shaving.

7. An assembly in accordance with claim 1, wherein said cutting edge portion of said blade means is bent from the remainder of said blade means in the direction of said seat, to reduce the said angle.

8. An assembly in accordance with claim 1, wherein said outwardly facing surface of said cap means is substantially larger than the opposed said blade seat, to thereby provide an enlarged said locating and reference plane.

9. An assembly in accordance with claim 1, wherein said outwardly facing surface of said cap means includes spacer ridges at the lateral edges thereof, to further preclude contact of the lateral edges of said blade means with said skin during shaving.

10. A shaving assembly for use in shaving bodily hair, comprising in combination:

a razor blade cap secured to a blade seat with blade means sandwiched therebetween; said cap having a substantially planer locating face for contacting the surface of skin to be shaved and for locating and orienting said assembly with respect to said skin; handle means extending from said assembly for grasping and drawing said assembly across said skin in a given direction with said locating face in contact with said skin; said blade means having a portion terminating at a cutting edge and protruding in said given direction beyond the edge of said cap; said protruding portion making an angle of from about −5° to +14° with respect to said locating face of said blade cap; and said cutting edge being spaced from said locating face in the direction of said seat; whereby bodily hairs to be shaved by said assembly are cut in scythe-like fashion by said cutting edge intersecting said hairs above the skin, and substantially without the said cutting edge contacting the skin.

11. An assembly in accordance with claim 10, wherein said angle is from about 0° to +6°.

12. An assembly in accordance with claim 10, wherein said blade means cutting edge portion protrudes beyond the said cap edge in the range of from about 0.003 to about 0.020 inches.

13. An assembly in accordance with claim 10, wherein said handle means makes an angle in the range of from about 12° to 18° with respect to the locating face of said cap.

14. An assembly in accordance with claim 10, wherein said cap is secured to said seat by projections from the one engaging with openings in the other in an interference fit.

* * * * *